US005169158A

United States Patent [19]

Neville

[11] Patent Number: 5,169,158

[45] Date of Patent: Dec. 8, 1992

[54] DART BOARD FOR SAFETY DARTS

[76] Inventor: John J. Neville, 4500 Martin Way #31, Olympia, Wash. 98506

[21] Appl. No.: 835,225

[22] Filed: Feb. 13, 1992

[51] Int. Cl.[5] ..... F41J 3/00

[52] U.S. Cl. ..... 273/408; 273/409

[58] Field of Search ..... 273/408, 409, 347

[56] References Cited

U.S. PATENT DOCUMENTS

| | | | |
|---|---|---|---|
| 1,527,480 | 2/1925 | Hooper | 273/408 X |
| 2,770,460 | 11/1956 | Deasy | 273/408 X |
| 2,818,259 | 12/1957 | Arenson | 273/408 |
| 2,900,188 | 8/1959 | Lemon | 273/408 |
| 3,244,419 | 4/1966 | Lerman | 273/408 |
| 3,309,091 | 3/1967 | Haecker | 273/408 |
| 5,029,874 | 7/1991 | Lamboy | 273/408 |

*Primary Examiner*—William H. Grieb

*Attorney, Agent, or Firm*—Glenn D. Bellamy

[57] ABSTRACT

A dart board for use with soft or blunt-tipped safety darts. The dart board includes a rigid backboard, a foam layer of low density foamed polystyrene attached to a surface of the backboard and which presents a target surface. A mesh screen covers the target surface and has a plurality of openings therein sized to allow penetration of a dart tip for retention in said foam layer and sized to prevent dart tip penetration of a depth at which a dart tip would contact said backboard.

11 Claims, 1 Drawing Sheet 10
12
14
15
16
18
20
22
24
26
28
30
32
34
36
38
40
41
42
A 1 2 3 4 5 6 7 8 9 10 0 0
B 1 2 3 4 5 6 7 8 9 10 0 0
C 1 2 3 4 5 6 7 8 9 10 0 0
D 1 2 3 4 5 6 7 8 9 10 0 0
© 1988, 1989 DOUBLE-O-DART GAMES INC.

DART BOARD FOR SAFETY DARTS

DESCRIPTION

1. Technical Field

This present invention relates to a dart board having a foam core and screen covering and the improved "self-healing" properties for use with soft-tipped or blunt-tipped lightweight darts.

2. Background of the Invention

In traditional and commonly-used dart games, the dart or missile usually has a heavy or weighted body with a plurality of feathers or flights at the trailing end and a sharpened metal pin at the forward end. These traditional sharp darts are thrown against a cork, wood, fiberboard, or the like target board. The sharp metal point penetrates therein and remains in place until removed by the player after counting of the score. The use of such darts has always been considered extremely dangerous and unsuitable for use by children because the sharp metal point can easily enter a person's flesh and cause injury and will also scratch or otherwise mar walls, furniture, and the like stuck by the dart.

There have attempts to reduce the danger of dart games by the use of rubber suction cups, bristles and other resilient members on the forward end of the darts. However, such attempts have not produced satisfactory results because of the high percentage of misses due to the dart rebounding from the target or not remaining securely thereon.

Others have produced lightweight darts having a somewhat flexible and/or blunted tip. Such darts, sometimes referred to as "safety darts," are considered safe for use by children with appropriate adult supervision as they are much less likely to penetrate and cause injury or damage to a person, walls, or furniture. Typical target boards designed for use with heavy, sharpened-tip darts will not accommodate these soft- or blunted-tip darts.

Two types of dart boards have been developed for use with such safety darts. The first is a board having a surface made of relatively rigid material virtually covered by a multitude of countersunk holes having a diameter which closely matches that of the associated dart tip. Such boards are less than satisfactory because it is virtually impossible to cover the entire surface with such holes, and an unacceptable percentage of dart throws will strike on an area of the board between holes, causing the dark to be deflected and drop. Also, even when darts strike the board at or near the countersunk opening, only darts approaching the board at relatively perpendicular angles will be guided into the tight opening.

The second type of alternative dart board is formed of a cellular synthetic resin or the like such as is sold by The Dow Chemical Company of Midland, Michigan, under the trade name of "STYROFOAM." Such a dart board is described in U.S. Pat. No. 2,818,259, granted Dec. 31, 1957. A target of this type is not fully satisfactory in that darts striking the board at extreme oblique angles can easily chip and mar the surface of the foam material, thereby degrading the appearance of the target after several uses. Also, darts which are thrown very hard at the foam material of the target can penetrate so deeply as to form an enlarged, permanent, "non-healing" hole therein, such that when a second dark strikes the same location, it will not be retained in place by the board. If the foam material is placed over a rigid backboard or wall surface, darts penetrating through the thickness of the foam material can strike the backboard or wall with sufficient force to cause the dart to bounce backward from the target or to mar the wall surface.

Another dart and target apparatus with the object of enhancing safety is shown by U.S. Pat. No. 2,770,460, granted Nov. 13, 1956. This patent discloses a missile or dart-type game device in which the target is a rigid wire screen mesh sized to grip and compress darts having a tapered, resiliently-compressible tip. This apparatus relies on the compressibility of the dart tip to create sufficient friction to retain the dart in engagement with the screen mesh. The specialized darts used with this system are not known to be commercially available today. Such a system also requires that either the dart tips be relatively large in diameter or the screen mesh be relatively fine in gauge in order to assure reliable frictional engagement of the dart in the target. These requirements have the undesirable effect of substantially reducing the area of the target which presents a suitable striking zone.

SUMMARY OF THE INVENTION

The present invention provides a dart board for use with safety darts comprising a rigid backboard, a foam layer or low density foamed polystyrene attached to a surface of the backboard and presenting a target surface, and a mesh screen covering the target surface. The mesh screen includes a plurality of openings sized to allow penetration of a dart tip for retention in the foam layer and sized to prevent dart tip penetration of a depth at which a dart tip would contact the backboard.

Target indicia may be printed directly on the foam layer or on a paper layer sandwiched between the foam layer and the screen mesh. The screen mesh may be made of a flexible material which allows it to be slightly deflected by a striking dart tip. The mesh screen may be adhesively affixed directly to the target surface and/or may be attached at edges to the backboard.

The target may also include a storage cavity formed in the foam layer to allow storage of darts therein prior to sale of the game apparatus or between uses thereof. The board may also include an area uncovered by the mesh screen which may be used for recording a player's score, or the like.

Other aspects and features of the present invention will become apparent from examination of the drawings, the description of the best mode for carrying out the invention, and the claims appended hereto. Each of these is incorporated herein by reference and constitutes further disclosure of the present invention.

BRIEF DESCRIPTION OF THE DRAWINGS

Like reference numerals are used to indicate like parts throughout the various views of the drawing, wherein.

BEST MODE FOR CARRYING OUT THE INVENTION

Figures 1, 2:
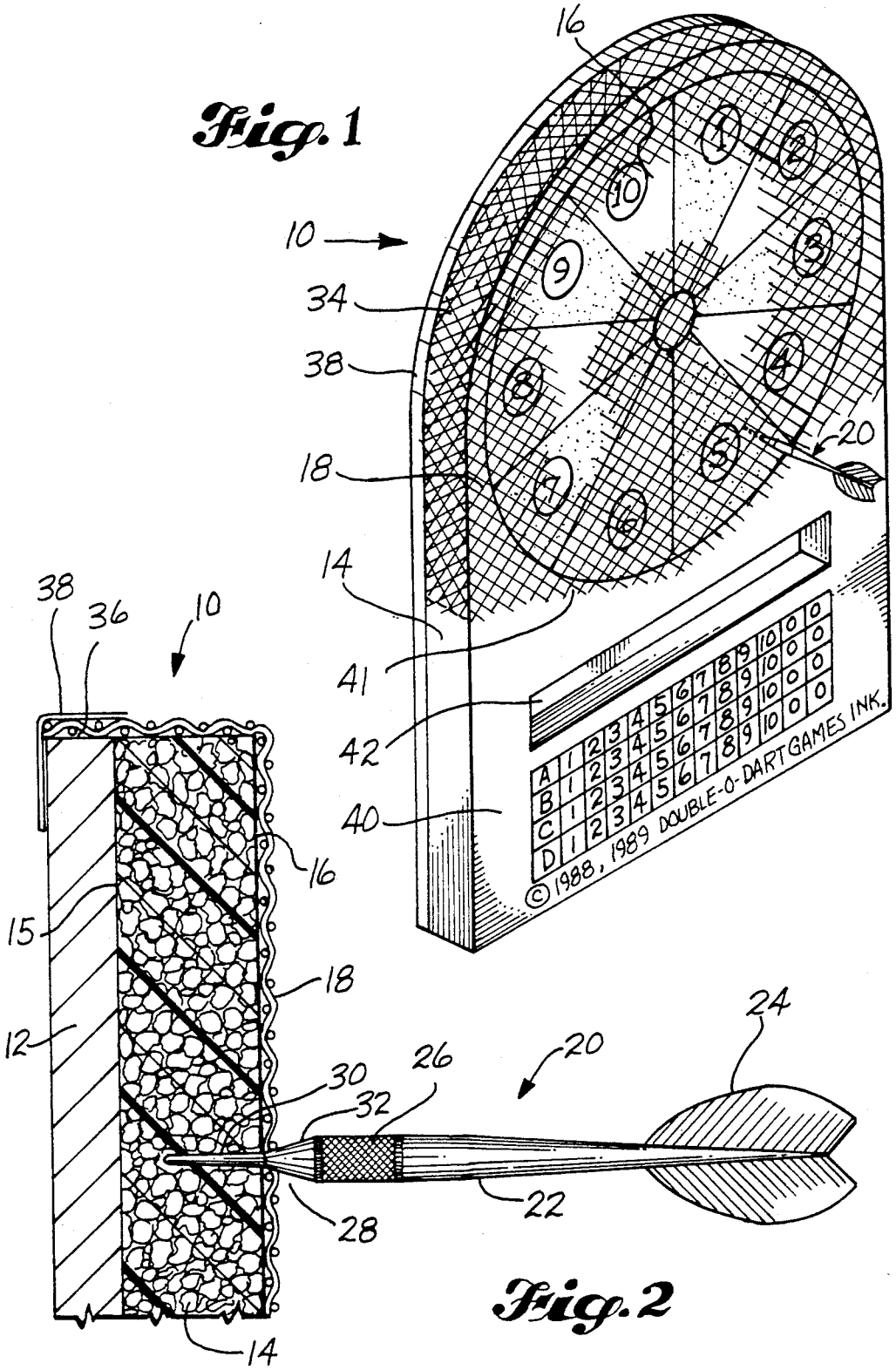
FIG. 1 is a pictorial view of the dart board of the present invention.
FIG. 2 is a cross-sectional view of the dart board of the present invention showing a dart penetrating therein.

Referring in more detail in both figures of the drawing, therein is shown at 10 at dart board constructed according to the preferred embodiment of the present invention. The dart board 10 comprises a rigid backboard 12 made of wood, plywood, particle board, plastic, or the like. Any of the above-listed materials are suitable and will fulfill the desired requirements of being relatively rigid, lightweight, and inexpensive. A layer of low density foamed, multicellular polystyrene material (at 14) is affixed to a surface of the backboard 12. This material may be composed of interconnecting or non-interconnecting minute cell systems in which the walls defining the cells are very thin and have some rigidity. A suitable material such as is old by the Dow Chemical Company of Midland, Mich., under the trade name "STYROFOAM" or other similar material having similar characteristics is preferred. Such material is available in various densities and cell sizes. It is preferred that a low density material be selected for best results. Higher density materials require greater forces for penetration and/or rupturing the cell walls by a dart tip.

The foam layer 14 may be attached to the backboard 12 by adhesive 15 or other suitable means. In preferred form an adhesive sold under the trademark "LIQUID NAILS" is used to provide excellent bonding without chemical degradation of the polystyrene foam.

The foam layer 14 presents a target surface 16. If desired, the target surface 16 may be printed, painted, silk screened, or the like with a bull's-eye or other target indicia. The dart board of the present invention is especially suitable for use with the dart game known as "DOUBLE-O-DARTS" as shown in my U.S. Copyright Registration No. VA 333-241, effective Dec. 23, 1988. The present invention may also be imprinted with target indicia of traditional English darts, thereby providing a safer version of this well-known, traditional game.

In preferred form, target indicia is printed on a paper layer which is attached to the target surface 16 of the foam layer 14. A thin paper layer does not significantly increase the force necessary for a lightweight dart to penetrate the low density foam material 14. However, because of the fibrous, sheet-like nature of the paper, the "self-healing" properties of the dart board 10 are further enhanced.

The target surface 16 of the foam layer 14 is covered with a sheet of flexible screen mesh material. In preferred form, this material is colorless and is made of polyethylene, nylon, or the like. Such material is very durable and is commonly available and used for a variety of purposes. One common use of the material is as an erosion prevention means over newly planted lawns or landscapes. This material is very lightweight, thin and flexible.

The preferred screen mesh has openings of approximately one-eighth inch by one-eighth inch and is formed of fibers which are substantially round in cross section. Such a shape facilitates the successful deflection of a dart tip toward the target surface 16 in the rare event of a direct hit by a dart. Also, because the diameter of the screen fibers are significantly smaller than that of the soft or blunt-tipped dart, the screen mesh is unlikely to significantly impede penetration of a dart into the foam layer 14. Also, because the screen mesh material 18 is somewhat flexible, a strand of the mesh is easily deflected to accommodate entry of a dart tip.

Referring specifically to FIG. 2, therein is shown at 20 a dart of preferred construction for use with the board 10 of the present invention. As is typical with any dart of missile-like game piece, the dart 20 includes a shaft 22 with a plurality of feathers or flights 24 at its trailing end. A metal ferrule 26 connects the shaft 22 of the tip 28. Alternatively, the entire dart 20 may be molded of a single piece of polyethylene or other suitable thermoplastic material. As is typical of commonly available soft or blunt-tipped darts, the preferred dart 20 has a forward shank 30 of relatively uniform diameter and an attachment shoulder 32 of increasing diameter. This shoulder portion 32 may be tapered, as shown, or can be relatively blunt.

The tip portion 28 can be formed of a stiff but relatively soft rubber, hard rubber, or slightly flexible plastic such as polyethylene. It is not necessary that the tip portion 28 have any significant compressibility or elasticity. When the cellular structure of the foam sheet 14 is struck by the forward shaft 30 of the dart tip 28, it will penetrate into the cellular structure, forcing the cell walls aside and forming a hole at the point enters the foam layer 14. The cellular walls have a slight elasticity causing them to press inwardly from the sides of the hole formed to frictionally engage the forward shaft 30 of the dart and prevent the dart 20 from being displaced by gravity of jars due to other darts 20 striking the target board 10. The dart can then be easily removed from the foam layer 14 of the dart board 10 by a rearward pull thereon. The elastic nature of the cellular material will cause the opening formed by the dart tip 28 to partially close or "self-heal" when the dart 20 is removed. If another dart 20 strikes the exact location of a previous strike, the cellular structure of the foam layer 14 retains sufficient elasticity to again grip the forward shaft 30 of the dart tip 28. A subsequent strike adjacent the location of a previous strike will cause cells of the foam layer 14 to shift, partially or completely occluding the previous opening. This further contributes to the "self-healing" nature of the dart board 10. As previously described, if the target surface 16 of the dart board 10 is covered with a paper layer, the broken paper fibers will tend to spring back to a near-original position after removal of a dart 20. This aids in retaining a pleasing appearance of the target surface 16, even after extensive use.

As previously described, the openings of the mesh screen 18 are sized to easily receive the forward shaft 30 of the dart's tip 28. The shoulder portion 32, however, is sized larger than the openings of the screen mesh 18 and limit the extent to which the tip 28 can be embedded in the foam layer 14. This function will be effective regardless of the flexibility of the screen mesh material 18, compressibility of the dart tip 28, or lack thereof. The thickness of the foam layer 14 should be selected to be at least as thick as the expected penetration of the dart tip 28. The dart board 10 of the present invention uses the elastic nature of the foam material 14 to grip the forward shaft 30 of the dart tip 28 and does not rely on friction between the screen mesh 18 and the shoulder portion 32 of the dart tip 28 for holding the dart 20 in place on the target 10.

In preferred form, the screen mesh material 18 is wrapped around edges 34 of the dart board 10 and secured to edges 36 of the backboard 12 is staples, tacks, or otherwise. In order to provide a smooth edge and attractive appearance, a strip of adhesive tape 38 may be used to cover the raw edge of the screen mesh material 18.

If desired, an adhesive may be used over the entire target surface 16 to attach the screen mesh 18 thereto. This, however, is not deemed necessary or preferred by the inventor.

Referring to FIG. 1, an area 40 may be provided on the board 10 which is printed with indicia for recording score of various players. For example, score may be kept by moving a thumbtack or pin along a chart as each player takes his or her turn. It may be deemed desirable to keep this area 14 free of the screen mesh material 18. Because this are 14 is not an area targeted by players throwing the darts 20, the functional benefits of the screen mesh 18 are not required in this area 40. Also, the screen mesh 18 could impair the use of some indicator pieces, depending on the type or scoring device used.

If the screen mesh material 18 is attached around edges 36, as shown, rather than by adhesive over the entire surface, it may be deemed desirable to secure the free edge 41 to the target surface 16. This may be accomplished in a variety of well-known ways, although it is preferred to use "tacks" or spots of adhesive as necessary along this edge 41.

The dart board 10 may also be provided with a storage cabinet 42 formed in the foam layer 14. This storage cavity 42 can be sized to accommodate the commonly used number of darts 20 as well as any scoring indicator pieces. The storage cavity 42 can be used during transport and display of game boards 10, allowing the boards 10 to be stacked or shelved flat and without damage to the darts 20 packed therewith. The storage cavity 42 can also be used by the customer after purpose for a similar purpose and to discourage unauthorized use of the game.

In preferred form, the storage cavity 42 is formed on the front side of the game board 10 through the entire thickness of the foam layer 14. The cavity 42 is closed on the back side by the backboard 12. Alternatively, an opening may be formed in the backboard 12 allowing access into a storage cavity from the rear of the game board 10. In such a case, the storage cavity 42 would not be open to the front of the board 10. Such construction is not presently preferred by the inventor due to increased construction costs. However, such construction would further discourage theft of darts from the game board when displayed at a point of purchase and would also allow the consumer to discourage unauthorized use of the darts 20.

The above-described embodiment represents the inventor's contemplated preferred mode of constructing the invention. The details described are for illustrative purposes only and are, therefore, nonlimitive. Many variations can be made in the described construction of the dart board without departing from the spirit and scope of the present invention. Therefore, my patent protection is to be limited only by the following claim or claims, interpreted according to well-known doctrines of claim interpretation, including the doctrine of equivalents.

What is claimed is:

1. A dart board for use with safety darts, comprising:
a rigid backboard;
a foam layer of low density foamed polystyrene material attached to a surface of said backboard, said foam layer presenting a target surface; and
a mesh screen covering said target surface and having a plurality of openings therein sized to allow penetration of a dart tip such that retention of said dart tip is accomplished by said foam layer and said openings being sized to prevent dart tip penetration of a depth at which a dart tip would contact said backboard.

2. The dart board of claim 1, further comprising a paper layer positioned between said foam layer and said mesh screen.

3. The dart board of claim 2, wherein said paper layer includes target indicia thereon.

4. The dart board of claim 1, wherein said mesh screen is formed of a flexible material.

5. The dart board of claim 1, wherein said mesh screen is affixed by an adhesive to said target surface.

6. The dart board of claim 1, wherein said mesh screen is attached along edges of said dart board to said backboard.

7. The dart board of claim 6, wherein said mesh screen is affixed by an adhesive to said target surface.

8. The dart board of claim 2, wherein said paper layer includes target indicia thereon.

9. The dart board of claim 1, further comprising a dart storage cavity formed in said foam layer such that darts may be stored therein without projecting outwardly beyond said target surface.

10. The dart board of claim 1, wherein said target surface further comprises an area with indicia for recording a game's score.

11. The dart board of claim 10, wherein said area is devoid of said mesh screen covering.

* * * * *